US006016614A

United States Patent [19]

Best

[11] Patent Number: 6,016,614

[45] Date of Patent: Jan. 25, 2000

[54] LATERALLY ARTICULATED SKI BOOT

[76] Inventor: John D. Best, P.O. Box 9739, South Lake Tahoe, Calif. 96158

[21] Appl. No.: 09/075,459

[22] Filed: May 8, 1998

Related U.S. Application Data

[60] Provisional application No. 60/046,507, May 15, 1997.

[51] Int. Cl.[7] ..... A43B 5/04

[52] U.S. Cl. ..... 36/118.2; 36/117.1; 36/117.2

[58] Field of Search ..... 36/117.1, 117.2, 36/117.5, 118.2, 118.3, 118.7, 118.8, 118.9

[56] References Cited

U.S. PATENT DOCUMENTS

| | | | |
|---|---|---|---|
| 3,303,584 | 2/1967 | Werner et al. | 36/118.7 |
| 3,732,635 | 5/1973 | Marker | 36/118.7 |
| 3,969,833 | 7/1976 | Vaccari | 36/117 |
| 4,334,368 | 6/1982 | Chalmers, II et al. | 36/118.7 |
| 4,563,825 | 1/1986 | Tesser | 36/118.9 |
| 4,565,017 | 1/1986 | Ottieri | 36/118.9 |
| 4,601,118 | 7/1986 | Zanatta | 36/118.7 |
| 4,841,650 | 6/1989 | Dodge et al. | 36/117.7 |
| 4,916,835 | 4/1990 | Begey et al. | 36/118.7 |
| 5,107,608 | 4/1992 | Kreitenberg | 36/117 |
| 5,363,572 | 11/1994 | Marega et al. | 36/117.1 |

FOREIGN PATENT DOCUMENTS

| | | | |
|---|---|---|---|
| 570053 | 11/1993 | European Pat. Off. | 36/118.7 |
| MI92A01237 | 2/1996 | Italy | 36/117.1 |

OTHER PUBLICATIONS

Professional Ski Instructors of America, Alpine Manual 1996, pp. 60–62, 87–89, 112.

*Primary Examiner*—Paul T. Sewell
*Assistant Examiner*—Anthony Stashick

[57] ABSTRACT

A boot for alpine skiing with a rigid lower boot (12) pivotably connected to s rigid cuff (10). The pivot means enables the skier to perform edging by swinging the lower boot laterally in an arc relative to the cuff using muscular inversion or eversion at the ankle joint. The rigid cuff enables the skier to apply fore and aft leverage to the ski.

3 Claims, 5 Drawing Sheets

LATERALLY ARTICULATED SKI BOOT

This application claims benefit of Provisional Appl. 60/046,507 filed May 15, 1997.

BACKGROUND—FIELD OF INVENTION

This invention relates to ski boots. In particular it relates to an alpine boot with improved edging capability.

BACKGROUND—DESCRIPTION OF PRIOR ART

An important function of a ski boot is to transmit forces from the lower leg and foot of the skier to the ski in order to control the motion of the ski.

The earliest boots manufactured specifically for use with skis were made of leather. These boots were attached to the ski only by a hinge at the toe of the boot. Such boots allowed the skier to transmit torque along an axis perpendicular to the ski, and to edge the ski by tipping it on edge. Fore and aft leveraging of the ski was not possible with these boots due to the free heel and the flexibility of the boot. This lack of fore and aft leverage necessitated a style of skiing that is highly dependent upon skidding and rotation of the skis to accomplish turning.

The advent of ski bindings which held the heel of the boot securely attached to the ski enabled the skier to apply fore and aft leverage to the ski. This development made it easier for the skier to maintain balance and it also combined with a development in ski design known as sidecut to allow the skier to make a more efficient style of turn. Sidecut is the difference in width between the narrower waist of the ski and the wider tip and tail of the ski. When the ski is bent by pressure and leverage, sidecut causes the steel edge of the ski to inscribe an arc or turn upon the snow. This new style of turn is called a carved turn. It features much more engagement of the ski edge in the snow during the turn than the older pivot skid type of turn. Use of sidecut makes the turn easier, and greater edge engagement makes the turn more secure, than older style turns.

The skier applies fore and aft leverage to the ski by using the ski boot as a lever arm. Stiffer flexing ski boots serve as more effective lever arms than softer boots. The quest for stiffer ski boots culminated in the rigid plastic conventional ski boots in use today.

In addition to the ability to apply fore and aft leverage, another important ability required to accomplish and control a carved turn is the ability to perform tipping of the ski onto its edge, known as edging. The stiff cuff of a conventional hard plastic boot provides an excellent lever arm for applying fore and aft leverage while inhibiting lateral movement at the anke joint. Lateral stiffness has been widely regarded as a desirable property of ski boots because it facilitates edging by cumbersome lateral tilting of the entire lower leg. A disadvantage of a laterally stiff conventional ski boot is that it severely inhibits the use of lateral movement at the ankle joint for edging the ski.

Shaped or supersidecut skis with a greater amount of sidecut than conventional skis have recently been developed. These skis make carving an even more efficient means of turning. Carved turns on shaped skis feature greater edge angles and more edge engagement throughout the turn than turns on conventional skis. In consequence, the ability to edge the skis quickly and precisely, and to achieve greater edge angles has assumed paramount importance. This is particularly true for racers who seek the highest edge angles and the maximum engagement of the ski edge in the snow to lessen time wasting skidding.

The degree of edge angle which can be obtained with laterally stiff conventional boots is anatomically limited to the angle in which the lower leg can be tilted laterally. The ability to make finer adjustments in the edge angle is severely limited by the conventional boot having the effect of a cast on the ankle joint. Clearly, a ski boot which retains the ability of the conventional boot to apply fore and aft leverage to the ski, while allowing lateral movement at the ankle joint to provide quicker and more precise edging and achievement of higher edge angles, would be very desirable.

OBJECTS AND ADVANTAGES

Accordingly, objects and advantages of the present invention are: to provide an alpine ski boot which has the ability to apply fore and aft leverage to the ski while utilizing lateral movement at the ankle joint for quicker, more precise edging; and to provide a ski boot which permits the attainment of greater edge angles than a conventional boot.

Furthur objects and advantages are to provide a boot which allows edging in a more natural manner making the sport easier for beginners to learn, allows skill to be more easily achieved, and allows the foot to be more sensitive to the interaction between the ski and the snow. Still furthur objects and advantages will become apparent from a consideration of the ensuing description and drawings.

DRAWING FIGURES

REFERENCE NUMERALS IN DRAWINGS

Figure 1:
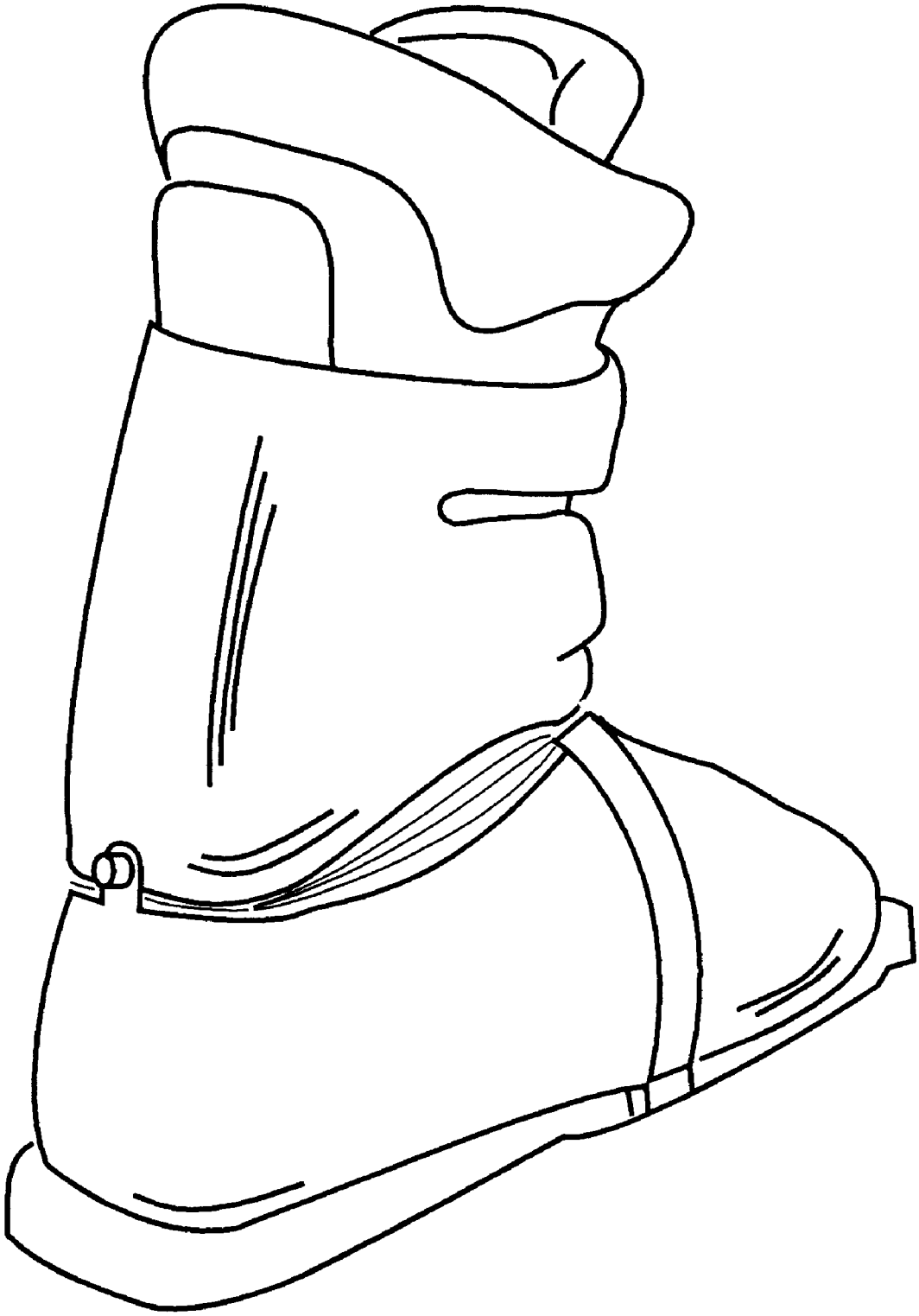
FIG. 1 shows an overall view of a laterally articulated ski boot.

10 cuff
12 lower boot
16 fore support
18 fore pivot
20 aft pivot
22 steel pin
24 flexible seal

SUMMARY

In accordance with the present invention an alpine ski boot comprises a rigid plastic cuff pivotably mounted to a rigid plastic lower boot, allowing the lower boot to swing in a lateral direction relative to the cuff.

DESCRIPTION—FIGS. 1 TO 6, 9

A boot for alpine skiing with a cuff that is pivotably mounted to a lower boot in a manner allowing lateral swing of the lower boot.

Figure 2:
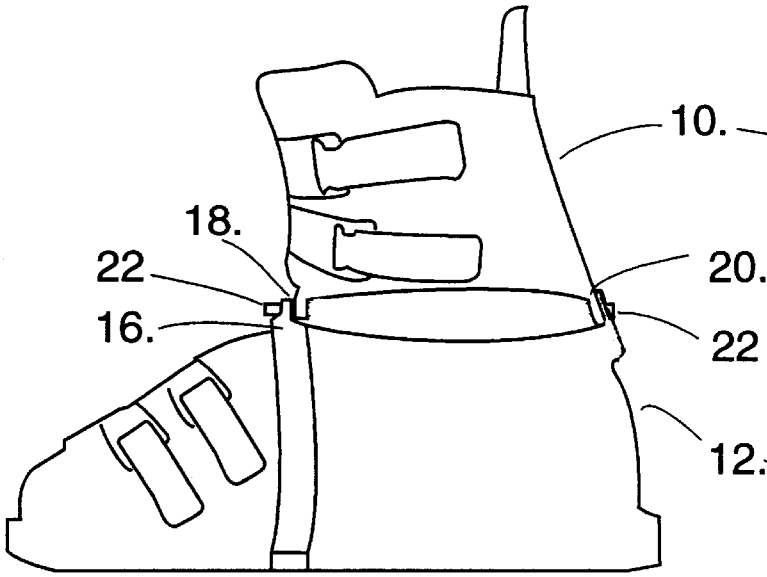
FIG. 2 shows a side view of a laterally articulated boot shell.

The preferred embodiment of the invention is illustrated in FIG. 1 (overall view) and in the subsequent figures. In the preferred embodiment the cuff, lower boot, and fore support are formed of rigid plastic. Other rigid or semi rigid material may be used. The side view shown in FIG. 2 illustrates the manner of connection between a cuff 10 and a lower boot 12. The cuff is connected to the lower boot by means of a hinge or pivot 18 at the fore end of the cuff, and another 20 at the aft end of the cuff.

Figure 3:
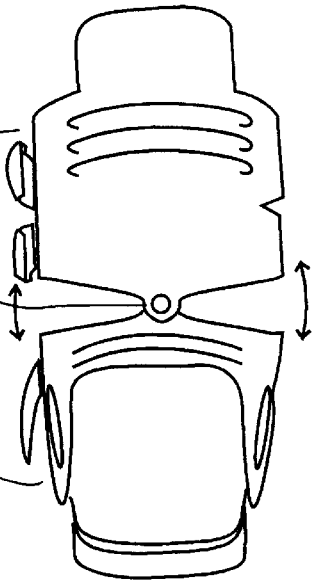
FIG. 3 shows a rear view of the boot shell.
Figure 4:
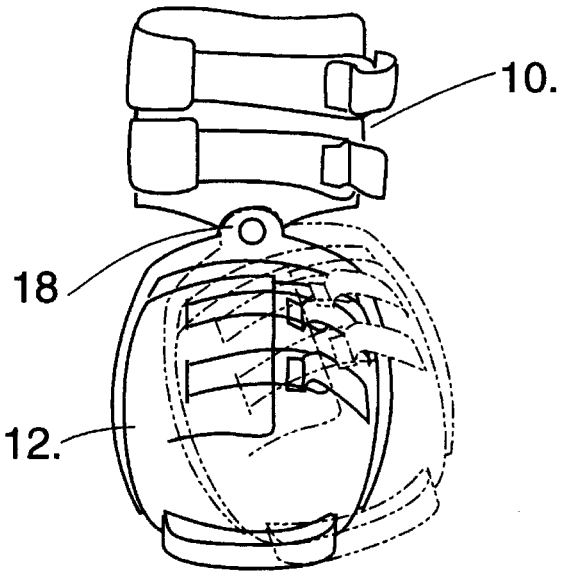
FIG. 4 is a front view showing swing of the lower boot.
Figure 5:
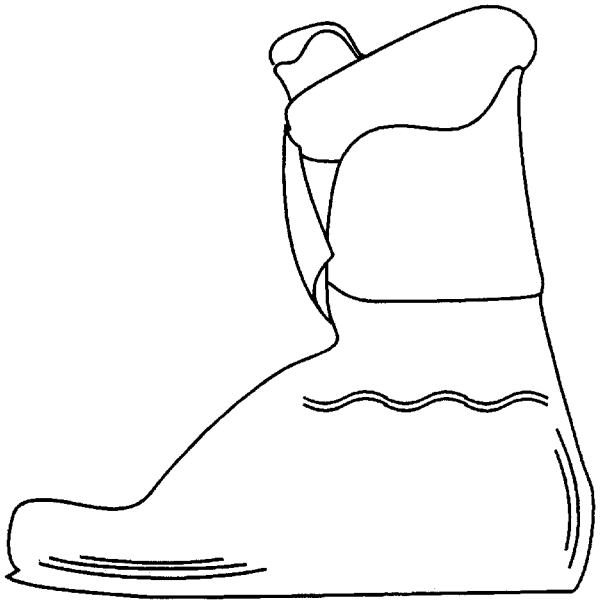
FIG. 5 shows a flexible inner liner.
Figure 6:
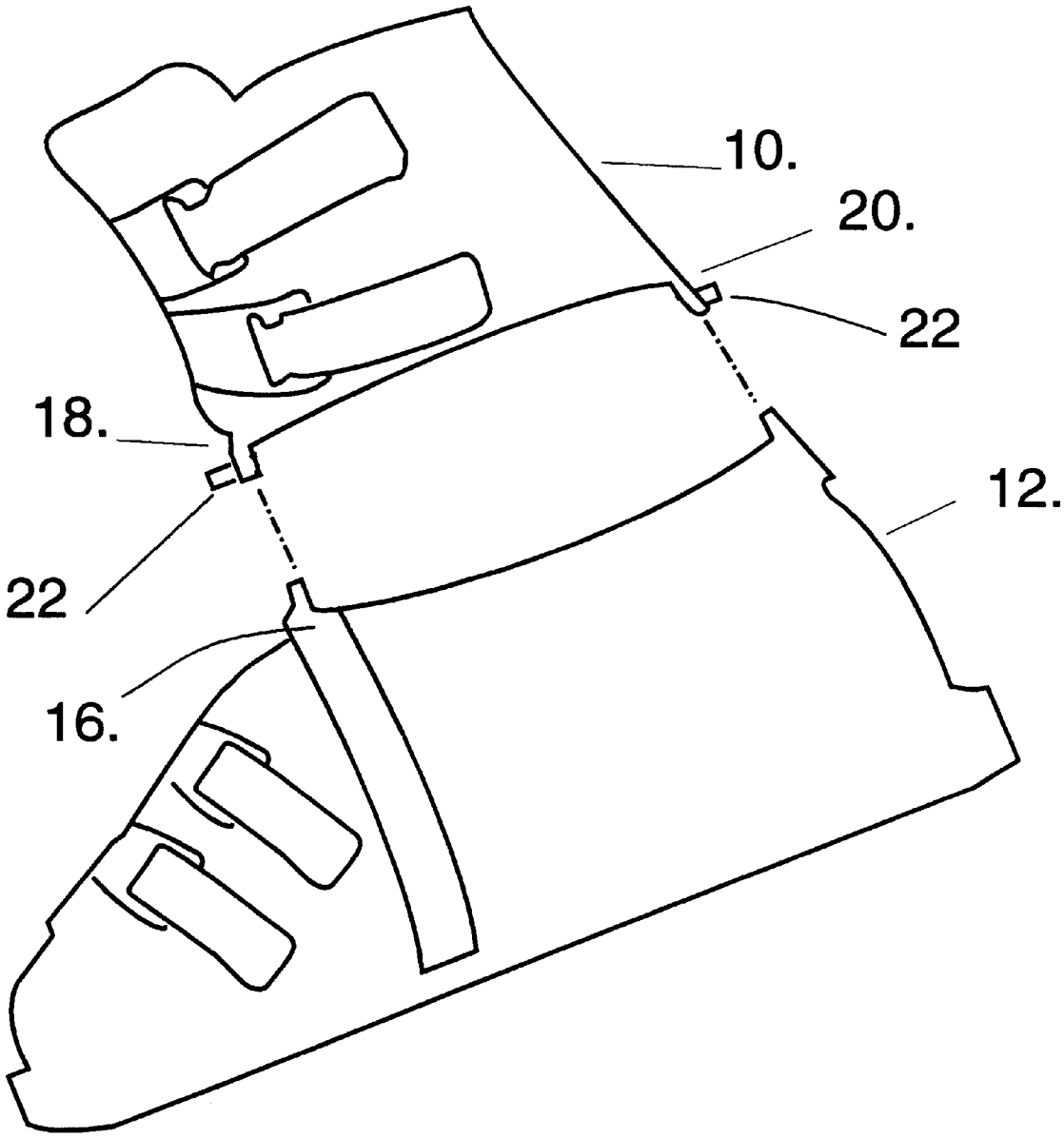
FIG. 6 is an exploded view of the boot.

The location of the fore pivot 18 is shown in FIG. 4 (front view) and the location of the aft pivot 20 is shown in FIG. 3 (back view). Sufficient clearance is provided between the cuff 10 and the lower boot 12 to allow the lower boot to swing in a portion of an arc to either side as illustrated in FIG. 4. In the preferred embodiment, the pivots can be comprised of steel pins of ⅜ in diameter and ½ in length. These pins have a flange at one end, which is securely embedded in the plastic of the cuff or otherwise attached so they extend from the bottom of the cuff in fore and aft directions. The pins fit into holes of a slightly larger diameter formed into the plastic material of the lower boot and fore support in the preferred embodiment as illustrated in FIG. 6 (exploded view). The fore support may be molded integrally as part of the lower boot in the preferred embodiment, or may be a rib of rigid material wrapping around the vamp of the boot and securely attached at the bottom. A flexible inner boot FIG. 5 sewn from plastic material in the preferred embodiment, or a flexible liner may be used inside the above described boot shell.

DESIGN ALTERNATIVES

Other types of pivots or hinges may be used in place of the above described. Connecting members of a material which will bend but resist compression may be used in place of pivots or hinges.

A means may be employed to vary the rigidity of the fore support, thereby regulating the forward flex of the cuff.

Figure 9:
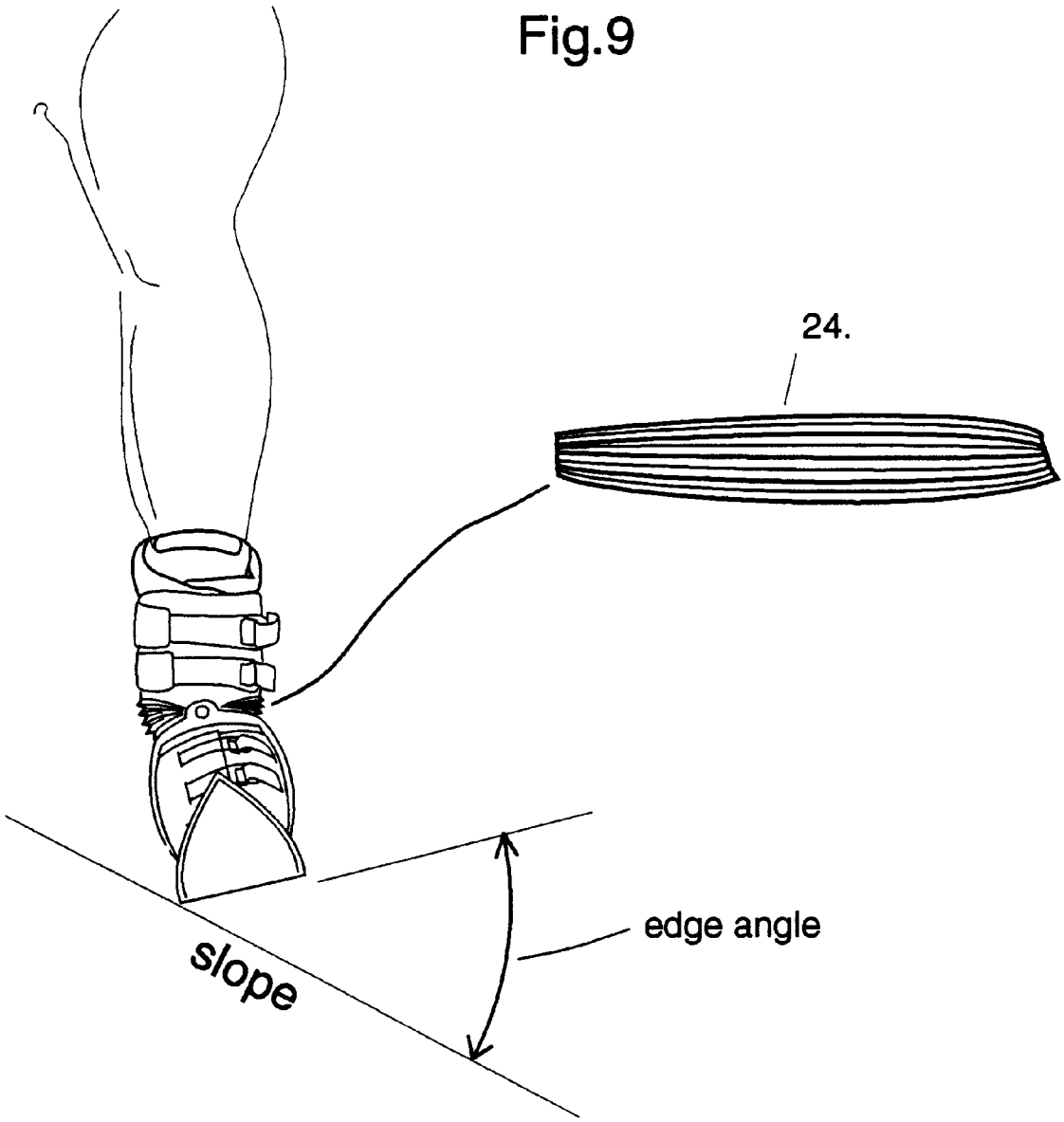
FIG. 9 shows a flexible membrane for sealing the gap between the cuff and lower boot against penetration by snow and moisture.

An accordion like membrane 24 as shown in FIG. 9 may be used to seal the gap between cuff and lower boot.

OPERATION—FIGS. 7,8

Figure 7:
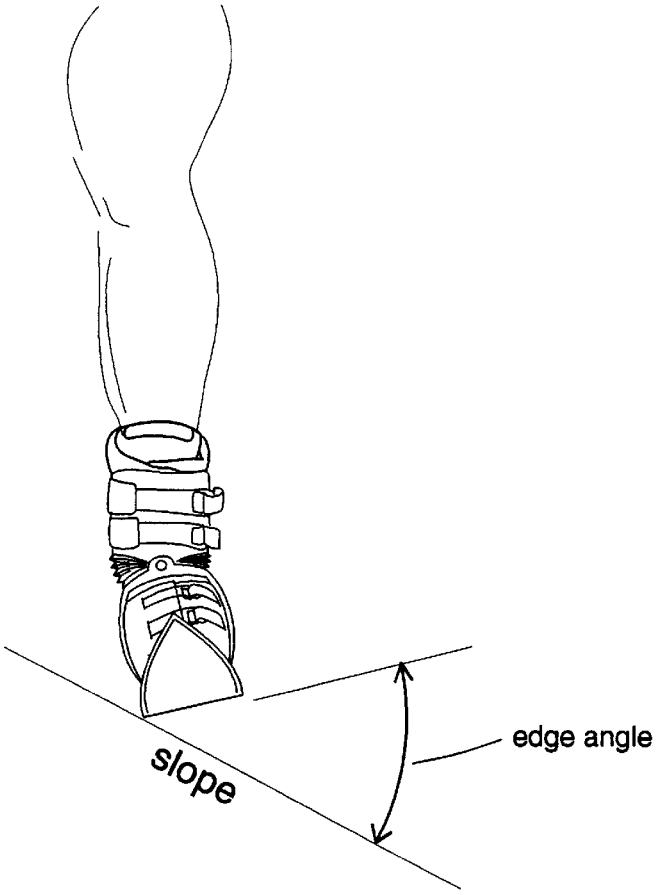
FIG. 7 shows a representation of edging with a laterally articulated boot.
Figure 8:
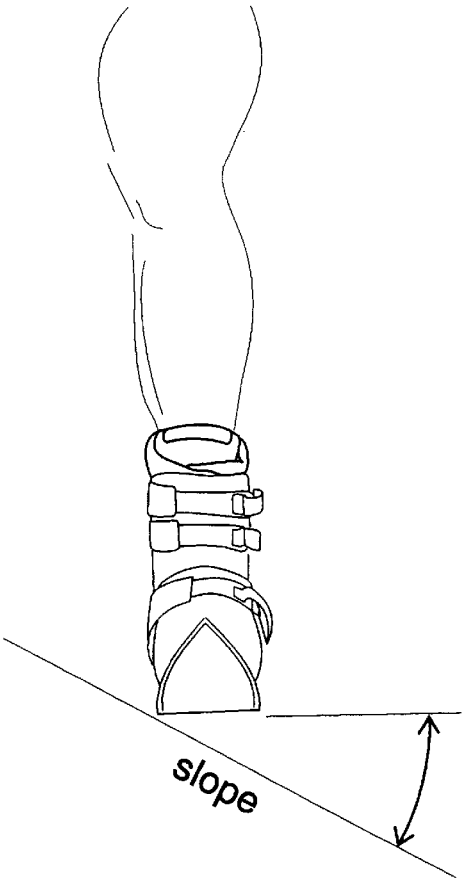
FIG. 8 shows a representation of edging with a conventional boot.

The ability to vary the edge angle, that is the angle between the ski and the snow as shown in FIG. 7, is essential to the alpine skier. Also essential is the ability to apply fore and aft leverage to the ski. Variation of the edge angle (edging) is performed with the laterally articulated ski boot by flexion at the ankle joint (inversion and eversion). The flexion causes lateral/angular displacement of the bones comprising the vamp and heel portion of the foot relative to the lower leg. The lower boot 12 portion of the laterally articulated ski boot is swung laterally relative to the cuff 10 by this motion of the foot. The swing of the lower boot affords the ability to vary the edge angle by tilting the sole of the boot relative to the bones of the lower leg. Fore and aft leverage on the ski is obtained by exerting forward or backward pressure with the lower leg against the cuff 10. The manner in which the laterally articulated ski boot is used is evident in FIG. 7 and contrasted with a conventional boot in FIG. 8.

SUMMARY, RAMIFICATIONS, AND SCOPE

Accordingly, the reader will see that the ability to swing the lower portion of the articulated ski boot represents additional edging capability over that provided by the conventional ski boot. The cuff of a conventional boot is securely attached on both sides preventing lateral swing. Edging must be achieved with a conventional boot, primarily by lateral inclination of the lower leg. This movement affords only limited ability to tilt the ski on edge and vary the edge angle. By additionally allowing swing of the lower boot relative to the cuff, the articulated ski boot provides quicker, more precise edging. It also allows the attainment of greater edge angles than possible with conventional boots. This is particularly important to competitive skiers. Edging with a laterally articulated ski boot represented in FIG. 7 is contrasted with a conventional boot in FIG. 8.

The alpine skier must be able to apply fore and aft leverage to the ski. This leverage is used to regulate distribution of pressure between front and back portions of the ski. The laterally articulated ski boot (and the conventional ski boot) provides this ability by means of a rigid or semi-rigid cuff. This cuff is attached in a manner which resists fore and aft inclination or flex, relative to the lower boot. By utilizing the cuff as a lever arm, forward and backward pressure is transmitted from the lower leg to front and back portions of the ski. Unlike the cuff of a laterally stiff conventional boot, the cuff of a laterally articulated boot allows lateral swing of the lower boot while serving as a lever arm to apply fore and aft leverage.

A ramification of the laterally articulated boot is that it provides the skier with the means to ski using a novel technique. This new technique allows the skier to make turns with more edge engagement and less skidding due to greater edge angles and more sensitive and precise edging. The skier is also able to ski with more quickness and dexterity using the new technique because edging movements of the ankle are much quicker than those of the knee and hip. An additional advantage of the new technique is that edging is performed in a more natural and intuitive manner. This makes the sport of skiing easier to learn.

Although the description above contains many specificities, these should not be construed as limiting the scope of the invention but as merely providing illustrations of some of the presently preferred embodiments of this invention. For example, the pivots can be made of flexible rubber or plastic. The pivots can be comprised of hinges designed differently than in the above description. The method of boot closure may be different than shown in the accompanying drawings. The scope of the invention is to be determined solely by the following claims. The claims should be interpreted to include modifications or equivalents.

I claim:

1. An alpine ski boot for permitting free lateral movement of the ankle joint, said ski boot consisting of:

a rigid plastic lower boot for surrounding a foot of a skier;

a cuff made of at least semi-rigid material for surrounding a lower portion of a leg of a skier;

pivot means for connecting the lower front and lower rear of said cuff to the upper front and upper rear, respectively, of said lower boot, said pivot means consisting of a pin and hinge hole connecting said cuff and said lower boot at a point forward of the lower portion of the leg and a pin and hinge hole connecting said cuff and said lower boot at a point aft of the lower portion of the leg;

said pins and hinge holes being coaxially aligned along a rotation axis;

said lower boot having upper lateral and medial side edges;

said cuff having lower lateral and medial side edges;

said lower boot upper lateral and medial side edges being so spaced from said cuff lateral and medial side edges as to provide sufficient clearance to permit free rotation of the cuff with respect to the lower boot about said rotation axis to allow the cuff to swing side to side with respect to the lower boot;

said pivot means allowing free lateral rotation of the cuff with respect to the lower boot.

2. The ski boot of claim 1 wherein said cuff and said lower boot are formed of plastics material.

3. The ski boot of claim 1 wherein said pivot means comprises portions of solid flexible material such as flexible rubber or flexible plastic.

* * * * *